US006083072A

United States Patent [19]

Brooks

[11] Patent Number: 6,083,072

[45] Date of Patent: Jul. 4, 2000

[54] SNOWSWIRL

[76] Inventor: Robert Patrick Brooks, 8 Tiffany La., Westport, Conn. 06880

[21] Appl. No.: 09/252,643

[22] Filed: Feb. 19, 1999

[51] Int. Cl.[7] ..... A63H 33/32; B29D 1/00; E04B 1/16

[52] U.S. Cl. ..... 446/70; 446/236; 249/59; 264/32; 425/470

[58] Field of Search ..... 285/38, 333, 390; 138/38, DIG. 11; 425/63, 470, 472; 249/59; 264/32–33, 308; 446/70, 85, 236

[56] References Cited

U.S. PATENT DOCUMENTS 1,319,048 10/1919 Davidson .
2,309,579 7/1943 Duran .
3,691,672 9/1972 Pendill .

*Primary Examiner*—Robert A Hafer
*Assistant Examiner*—Laura Fossum

[57] ABSTRACT

An apparatus for creating freestanding columns of compressible substances such as snow and sand. These freestanding columns can then be sculpted into any desired shape. The apparatus is placed on level ground, filled with the compressible substance after which the substance is compressed using hands or other implements. The operator then rotates the apparatus by pushing horizontally on the handles, thereby causing the apparatus to rise vertically due to the spiral grooves on the inside surface of the apparatus. As the apparatus rises vertically, the column of compressed substance remains stationary while creating space at the top of the apparatus for the addition of more of the compressible substance. The process is repeated until desired height is reached.

1 Claim, 4 Drawing Sheets

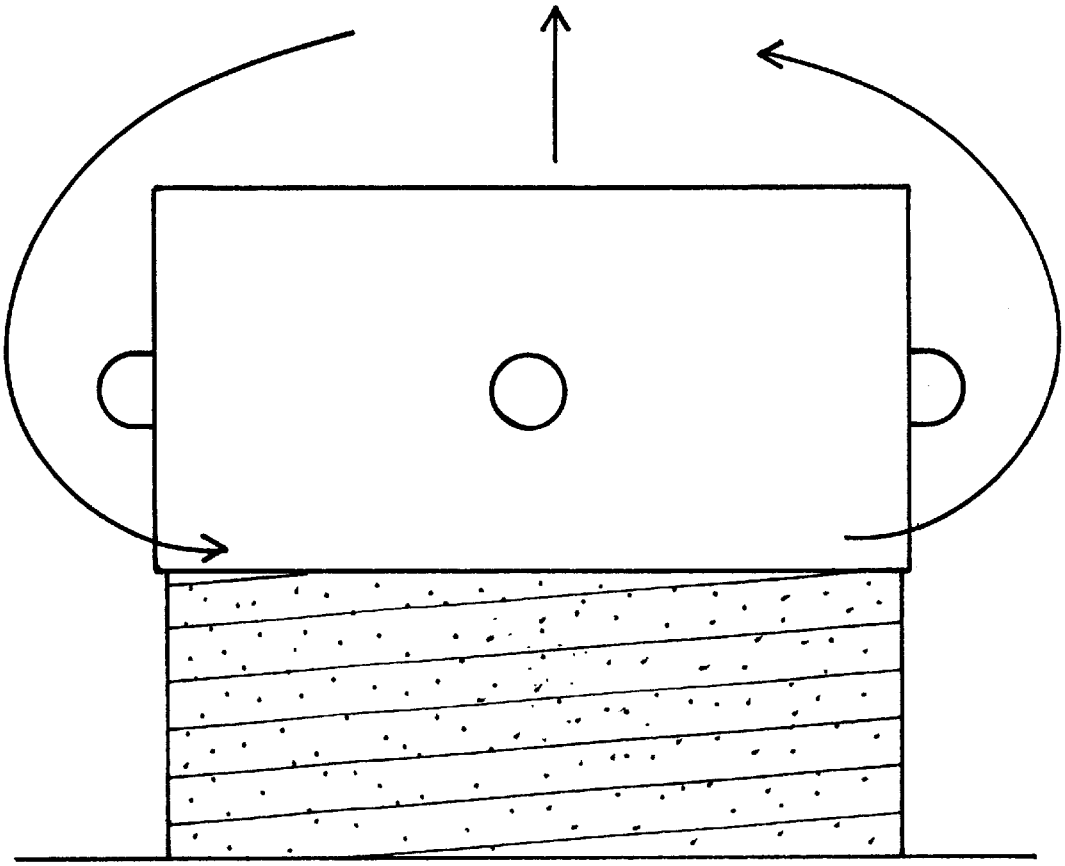
FIGURE 3D
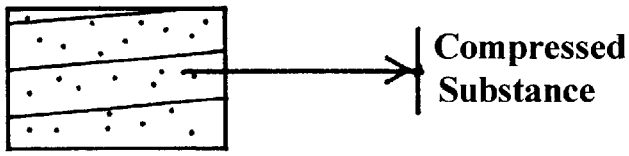

SNOWSWIRL

BACKGROUND

1. Field of Invention

This invention falls into the category of toys, toys which are generally used outside. Basically, it makes a vertically rising freestanding column of packed snow (or other malleable substances). It could be described as a better way to construct a "snowman". Yet the SNOWSWIRL is not limited to working exclusively with snow, it will work with other malleable substances which firm up after compressing with only hand-applied pressure.

2. Description of Prior Art

I have no knowledge of any other hand-operated device which allows someone to generate a column of freestanding packed snow (or other malleable substances). Other ways of preparing snow for sculpting include, to roll wet snow into large snowballs and then stack. Another method to create a block of compressed malleable substance is to assemble prefabricated-forms in which to fill with snow, sand . . . etc. The purpose being to compress the substance, then to remove the forms to reveal a mass of compressed substance in which to sculpt.

SUMMARY

The SNOWSWIRL (FIGS. 1A,B) is a hand operated device which allows anyone to create a column of freestanding compressed snow or other malleable substances (sand . . . etc.). The column can then be easily shaped (sculpted) into any desired shape or object.

**For the purpose of clarity the Malleable Substance I will be referring to in OBJECTS AND ADVANTAGES will be "Snow".

OBJECTS AND ADVANTAGES

Accordingly, several objects and advantages of my invention are that for the first time, a SNOWSWIRL allows almost anyone to create a freestanding column of packed snow. This can be accomplished with little effort by most anyone.

Someone may compact a snowball with their hands then roll it in the snow to make a larger snowball. The problem is these snowballs can become to heavy to move or lift. Whereas with the SNOWSWIRL someone is able to make a column of compressed snow as large as they want with never having to lift more than one shovel-load (or handful) of snow at a time.

The only limits to the size of the column is the diameter of the SNOWSWIRL and the height to which someone is able reach to fill and compress the snow.

Other methods to compress snow have been to assemble prefabricated-forms. Among the disadvantages to this method are that you need more than one form, and that it is labor intensive. First, the prefabricated-forms have to be assembled. Then after the forms are filled with snow and the snow is compressed, the forms must be removed. This process must be completed at every desired height increase.

Whereas, the SNOWSWIRL rises automatically with each easy turn to allow the input of more snow to be compressed.

DRAWING FIGURES

FIGS. 3A–3D Illustrate steps in proper use of the SNOWSWIRL

Figure 3A:
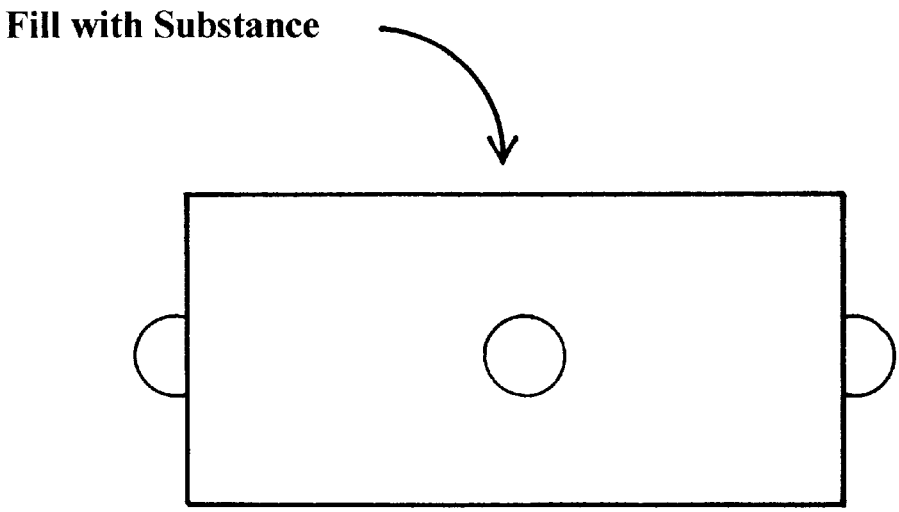

FIG. 3A Step 1, Place SNOWSWIRL on level ground and fill with snow

FIG. 3D Step 2, Compress the snow with hands

Figure 3B:
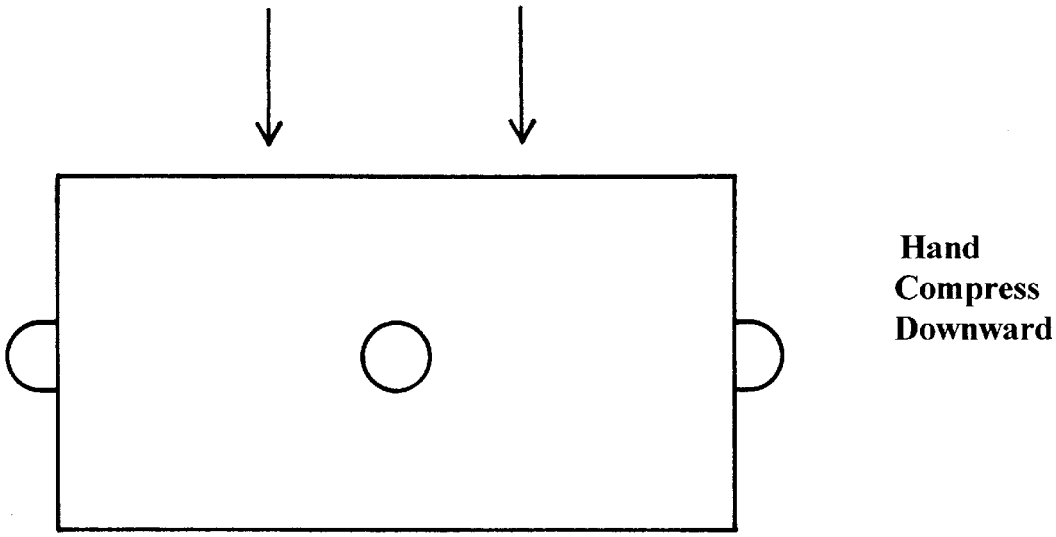
Figure 3C:
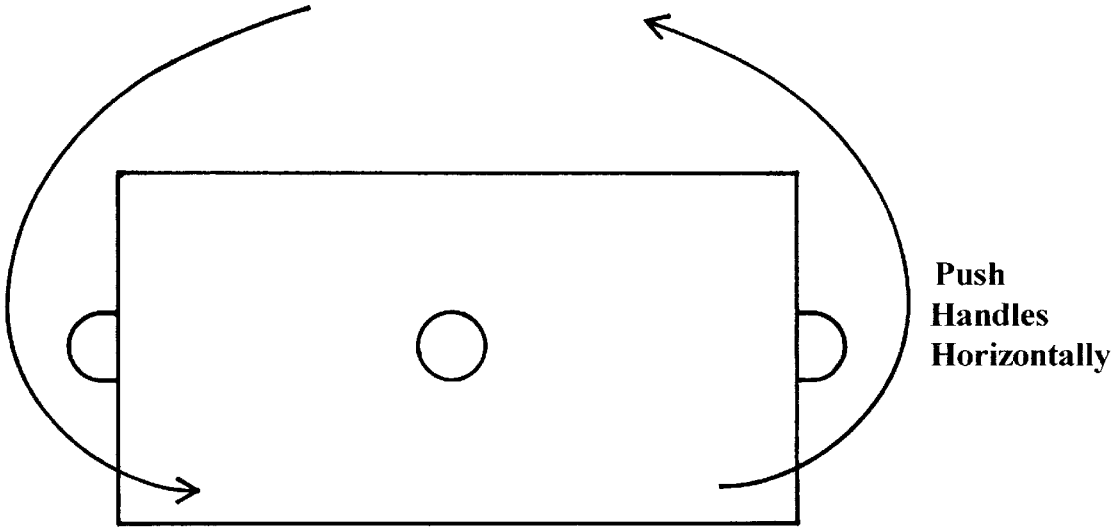

FIG. 3C Step 3, Turn SNOWSWIRL counterclockwise

FIG. 3D Step 4, As the SNOWSWIRL turns it also rises leaving a freestanding column of packed snow

REFERENCE NUMERALS IN DRAWINGS

1 Handle

2 Inclined track

**For the purpose of clarity, the Malleable Substance I will be referring to in DESCRIPTION and Operation will be "Snow".

DESCRIPTION

Figure 2:
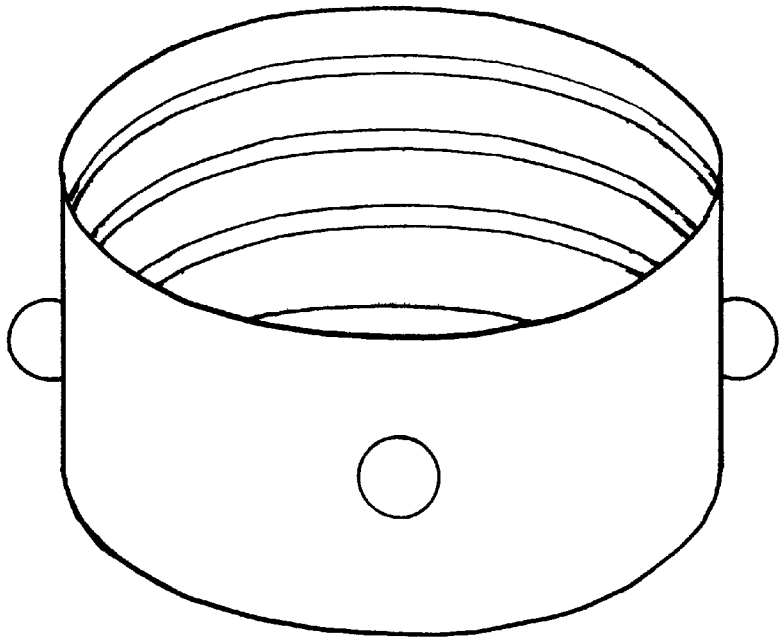
FIG. 2 Shows a 3D perspective of the SNOWSWIRL

FIG. 2 is a 3-demensional perspective of the SNOWSWIRL. It is a one piece construction of any toolable material, such as plastic or metal. The body is of a cylinder shape which is open at both ends.

Figure 1A:
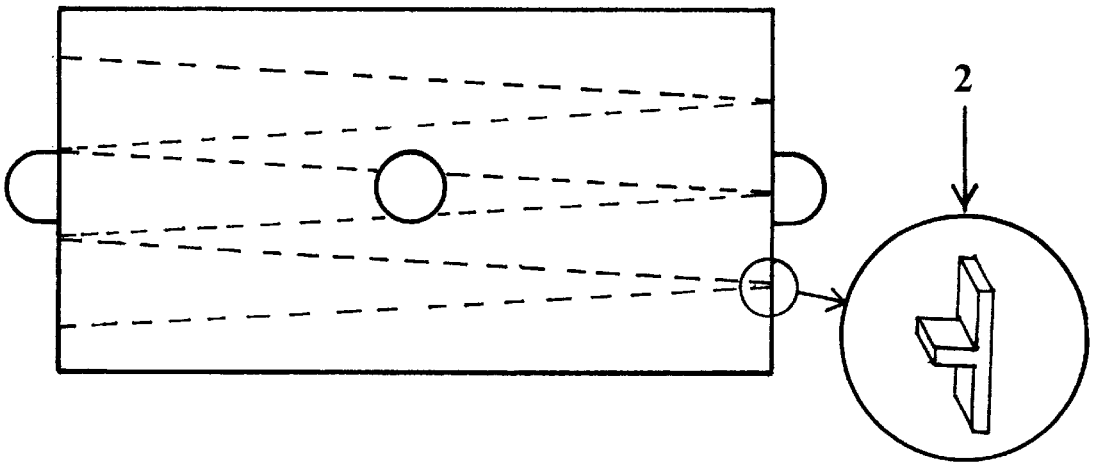
FIG. 1A Shows a side view of the SNOWSWIRL
Figure 1B:
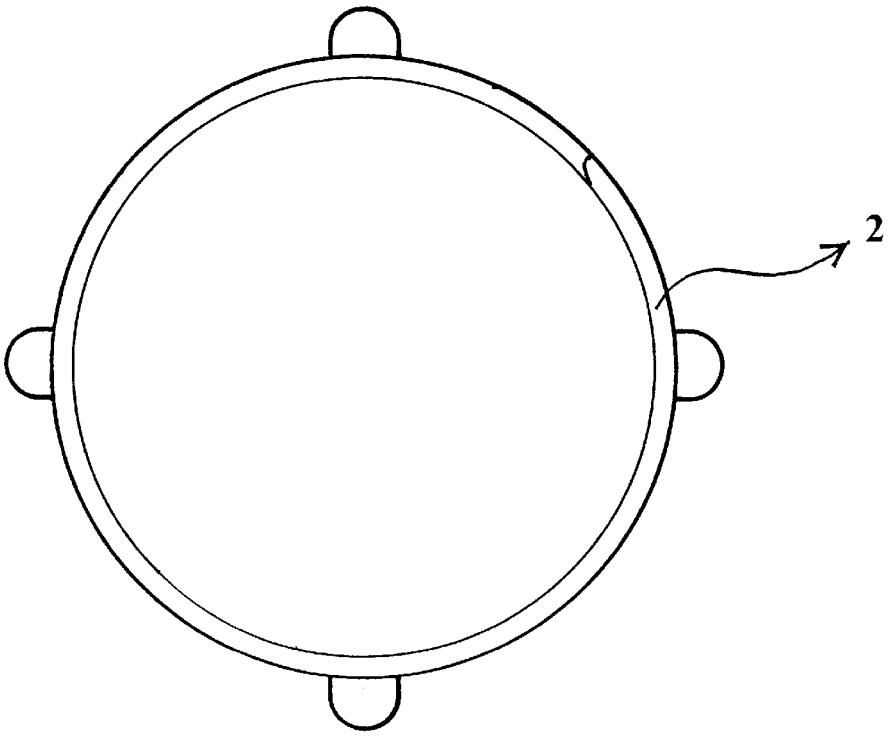
FIG. 1B Shows a view from above of the SNOWSWIRL

The exterior surface is smooth except for four handles (pushing points) placed at 90 degree intervals (FIGS. 1A,1B) around the outside and equally positioned between the top and bottom. The purpose of the handles are for turning the SNOWSWIRL and the placement or quantity of do not impact the operation. Meaning that the SNOWSWIRL will operate with one or more handles placed in a variety of positions.

On the inside surface there is an inclined track (groove) perpendicular from the interior wall (Ref Num. 2) (FIGS. 1A,B) which threads its way around the inside from the top to bottom. This track can wrap either clockwise or counterclockwise inside the SNOWSWIRL (the only impact of this variation in direction of the track is, if it wraps downward counterclockwise the operator pushes the handles left to make the SNOWSWIRL rise, and clockwise the operator pushes right). This track grips the compressed snow and causes the SNOWSWIRL to rise vertically. The degree of inclination of the track is dependent on the ease of which it is desired to turn the SNOWSWIRL. Meaning, a lower degree of inclination will increase the overall length of the track and require less effort to turn the SNOWSWIRL. Conversely, a high degree of inclination will decrease the overall length of the track and require more effort to turn the SNOWSWIRL.

The SNOWSWIRL can operate at any size yet dimensions are generally that the height of the cylinder wall is one-half that of the diameter.

Operation—FIGS. 3A,B,C,D

After placing the SNOWSWIRL on level ground, fill the SNOWSWIRL to the brim with snow (fresh or wet snow works best) (FIG. 3A). Then hand-compress the snow, by pushing down inside the SNOWSWIRL with your hands (approximately reduce snow volume by ½ or until firm) (FIG. 3B). Next by pushing on the handles, turn the SNOWSWIRL counterclockwise (FIG. 3C). This horizontal turning action will cause the inclined track to grip the compressed snow, thus causing the SNOWSWIRL to simultaneously rise vertically. This action will leave a freestanding column of compressed snow at the bottom while making space at the top for more snow to be placed in (FIG. 3D). A person can generate a column of freestanding compressed snow to any height they wish (limited by how high the person operating can reach). With this column of packed snow a person will be able to carve (sculpt) most any shape they wish.

CONCLUSION

Thus as I have demonstrated the reader can see that by using the SNOWSWIRL to create a column of freestanding compressed snow (or other malleable substance) is new and unique. It can be accomplished easily by most anyone with little effort. The SNOWSWIRL is easy to operate and easy to understand by anyone since there are so few procedures. So easy to use that a person would understand how to operate by only one demonstration. The SNOWSWIRL can be made in many sizes depending on the size of the free standing column of snow (or other malleable substance) which is desired.

What is claimed is:

1. An apparatus for creating a compressed freestanding column of a malleable substance, the apparatus comprising:

a cylindrical body having an interior cylindrical surface, an exterior cylindrical surface and first and second ends, said ends being fully open;

an inclined perpendicular track, on said interior cylindrical surface extending continuously from said first end to said second end; and a plurality of handles extending from said exterior surface, dimensioned and arranged to be grasped by a user;

wherein said cylindrical body, said inclined perpendicular track and said plurality of handles are constructed and arranged such that when the cylindrical body is filled with a malleable substance that is compressed therein, a user pushes on the handles to turn the cylindrical body about the compressed malleable substance, consequently causing the cylindrical body to vertically rise upon the compressed malleable substance, due to the inclined perpendicular track, after which the cylindrical body can be further be filled with the compressed malleable substance, and the steps continuously repeated thereby forming a freestanding column of the compressed malleable substance.

* * * * *